US005458178A

United States Patent [19]

Nakamura

[11] Patent Number: 5,458,178

[45] Date of Patent: Oct. 17, 1995

[54] LATTICE AND SECURITY DEVICE FOR EMERGENCY ESCAPE

[75] Inventor: Takashi Nakamura, Amagasaki, Japan

[73] Assignee: Nakamura Co., Ltd., Hyogo, Japan

[21] Appl. No.: 127,610

[22] Filed: Sep. 28, 1993

[30] Foreign Application Priority Data

| | | | |
|---|---|---|---|
| Oct. 27, 1992 | [JP] | Japan | 4-074712 |
| Dec. 8, 1992 | [JP] | Japan | 4-084366 |
| Dec. 8, 1992 | [JP] | Japan | 4-084367 |

[51] Int. Cl.[6] ..... E06B 9/30

[52] U.S. Cl. ..... 160/172 V; 49/56

[58] Field of Search ..... 160/172 V, 202, 160/166.1 V, 130, 201, 218; 49/50, 56

[56] References Cited

U.S. PATENT DOCUMENTS

| | | | |
|---|---|---|---|
| 879,342 | 2/1908 | Wells | 160/172 V X |
| 1,966,636 | 7/1934 | McGuiness | 160/172 V X |
| 3,426,653 | 2/1969 | Kawamura | 160/172 V X |
| 4,942,705 | 7/1990 | Nakamura . | |

*Primary Examiner*—David M. Purol

[57] ABSTRACT

A lattice for use in providing a security closure for an opening includes a plurality of elongated lattice members with individual sliders being integrated as a member of each of the plurality of elongated lattice members. A pair of hollow guide rails are provided. The plurality of elongated lattice members are slidably disposed substantially parallel with respect to each other and are spaced along a length of the pair of hollow guide rails with the individual sliders being engaged within a portion of the hollow guide rails. A cord member extends within the hollow guide rail and is attachable to each of the individual sliders for securing the positioning of the plurality of elongated lattice members in a first predetermined position.

11 Claims, 14 Drawing Sheets

LATTICE AND SECURITY DEVICE FOR EMERGENCY ESCAPE

BACKGROUND OF THE INVENTION

1. Field of the Invention

The present invention relates to a lattice having an emergency escape function and a lock security device that can be easily unlocked from inside but cannot be unlocked from outside the house.

2. Description of Background Art

Although a lattice is installed and fixed to the window opening on the outer side of a room for prevention of crimes, such fixed lattice may obstruct escape from the window opening in the case of an emergency such as fire which may, and lead to a tragedy. Therefore, it is suggested to adapt the lattice such that it is rotatable for opening to the front of a window opening or slidable for opening to the side of a window opening, locked to the window opening by a lock device in normal circumstances, and unlocked and opened in the case of an emergency such as a fire for allowing emergency escape from the window opening.

Such rotatable or slidable lattice is relatively complicated in structure, requires a sufficient space in front or to the side of a window opening, and cannot be installed when an obstacle such as an adjacent building is located in front or to the side of the window opening.

A lattice is employed on a window of a residence for prevention of a house breaking and the like.

In case of an emergency such as a fire, a lattice may obstruct escape from inside to outside, and cause an endangerment to human life. However, such a problem can be eliminated by providing an opening and closing lattice.

SUMMARY AND OBJECTS OF THE INVENTION

Generally, in an opening and closing lattice, although a lock device combining a movable lattice member to a closed position is provided for closing the lattice in normal circumstances, it is preferred that the lock device is constructed in such manner that it can be easily and swiftly unlocked by operating control means from inside for enabling a swift emergency escape.

Hence, in consideration of such a conventional problem, it is an object of the invention to prevent a lattice having a simple structure and an emergency escape function, and easily installable in a narrow space.

In addition, a lattice comprises a pair of guide rails positioned in parallel an opposed to each other with a predetermined spacing between them and a plurality of vertical bars bridged between the guide rails and secured at a predetermined interval along the longitudinal direction thereof. Such and such a lattice is conventionally assembly in a plant, and transported to an installation site.

It has been a problem with such a conventional lattice that the lattice is bulky because of the long guide rails, and expensive for transportation.

In consideration of such a conventional problem, it is another object of the invention to provide a lattice that is not bulky in transportation.

Referring now to the drawings, for achieving the above objects, the invention presents a lattice structured such that sliders 16 are integrated with or integrally provided in a plurality of lattice members $4_1$ to $4n$, respectively, that are bridged between a pair of generally hollow guide rails 3, 3, and aligned parallel in the longitudinal direction thereof, and the lattice members $4_1$ to $4n$ are slidably engaged with the guide rails 3, 3, respectively, by means of sliders 16, and mutually combined through the sliders 16, respectively, to a cord member 23 that is inserted through the guide rails.

In addition, the invention presents a lattice structured such that a pair of generally hollow guide rails 3, 3 comprising a plurality rail members 3A, 3B which are integrally combined with each other by means of a joint member 35 are positioned in parallel and opposed to each other with a predetermined spacing between them, sliders 16 are integrated with or integrally provided in a plurality of lattice members $4_1$ to $4n$, respectively, that are bridged between the guide rails 3, 3, and aligned parallel in the longitudinal direction thereof, and the lattice members $4_1$ to $4n$ are slidably engaged with the guide rails 3, 3, respectively, by means of the sliders 16, and mutually combined through the sliders 16, respectively, to a cord member 23 that is inserted through the guide rails.

Moreover, the invention presents a lattice structured such that concave recesses 15, 15 are provided in the lattice members $4_1$ to $4n$ so as to face the side of guide rails 3, 3, the sliders 16 are integrated with or integrally provided in the recesses 15, 15, and the guide rails 3, 3 are engaged in the sliders 16, so that a mutually overlapped part is formed between the sliders 16 and guide rails 3, 3.

Furthermore, the invention presents a lattice structured such that the guide rails 3, 3 are formed in a generally hollow structure by mutually joining two members, that is, a mold member 3*a* in the side of the slider 16 and a mold member 3*b* in the opposite side.

Additionally, the invention presents a lattice structured such that the guide rails 3, 3 are formed in a generally hollow structure by integrally forming mold members, that is, a mold member 3*a* in the side of slider 16 and a mold member 3*b* in the opposite side, respectively.

According to the invention, only by attaching a pair of guide rails 3, 3 to a window opening 2 (see FIG. 1), support post 27 (see FIG. 2), of an entrance or the like, and engaging a plurality lattice members $4_1$ to $4n$ with both guide rails 3, 3, in particular, a lattice can be easily formed, the lattice members $4_1$ to $4n$ can be automatically placed to predetermined positions on the guide rails 3, 3 simply by sliding the lattice members $4_1$ to $4n$ apart from each other, because the lattice members $4_1$ to $4n$ are mutually combined by means of a cord member 23 with a predetermined spacing between them, and by fixing only the lattice members $4_1$, $4n$ in both ends out of the lattice members $4_1$ to $4n$ that have been positioned, the remaining lattice members $4_2$ to $4n\text{-}_1$ are also positioned on the guide rails 3, 3.

In the case that a lattice 1 of the invention is formed, since the window opening 2 can be securely closed in normal circumstances, and crime prevention function maintained by fixing one member $4n$ of the lattice members $4_1$ to $4n$ in both ends is fixed to the guide rails 3, 3, and locking the other $4_1$ to the guide rails by means of a lock device (see FIG. 1), and the window opening 2 can be opened, in case of emergency such as a fire, simply by releasing the lock, and sliding the lattice members $4_2$ to $4n\text{-}_1$ (see FIG. 6), escape through the window opening 2 that is opened at emergency is possible.

In transportation of the lattice, as the guide rails 3, 3 can be disassembled to a plurality of rail members 3A, 3B for a shorter length, to be shortened, it is not bulky, and the transportation cost can be reduced. The guide rails 3, 3 can be undoubtedly used as a single member without dividing them into a plurality of members.

Also, according to the invention, because mutually overlapped parts are formed between the sliders 16 projecting from the recesses 15, 15 of the lattice members $4_1$ to $4n$ and the guide rails 3, 3, and a dimension of depth inside and outside a room is reduced by the overlapped part, the lattice 1 of the invention can be installed in the window opening 2 with a good appearance.

In addition, the lattice members $4_1$ to $4n$ and guide rails 3, 3 are rigidly integrated by the sliders 16, crime preventive and security functions are maintained.

Moreover, according to the invention, the guide rails 3, 3 comprise two mold members 3*a*, 3*b* that are in the side of slider 16 and the opposite side thereof, and a generally hollow guide rail with a high strength can be formed by mutually joining both members 3*a*, 3*b*.

Furthermore, by fitting the slider 16 between both members 3*a*, 3*b*, the slider 16 can be slid smoothly along the guide rails 3, 3, utilizing a small spacing formed between the members 3*a*, 3*b*.

According to the invention, since the two mold members 3*a*, 3*b* constituting the guide rails 3, 3 are integrally formed, respectively, the guide rails can be produced at a low cost through an extrusion molding step with a single die.

A problem is caused by a lattice for a house, because a lock device can be easily and swiftly unlocked by inserting a hand on the inside through a spacing in the lattice, and operating the control means.

The invention has been achieved in consideration of such circumstances as well, and it is the other object of the invention to provide a lock security device for a lattice that has a simple structure, and prevents the lock device from being unlocked from inside the lattice.

A lock security device for a lattice according to the invention comprises a lock device combining the lattice to a closed position and control means for releasing the locking function of the lock device, and is provided with the following means to achieve the object.

In other words, the lock security device comprises a front cover having a shape of box open in a rear face thereof, a rear cover covering the entire open face of front cover and rotatably supported in a lower part of the front cover, an intermediate cover swingably supported in a front part within the front cover at a position higher than the rotation center of the rear cover and a link coupling the intermediate cover and the rear cover, wherein the control means is positioned within the front cover between the intermediate and front covers.

The lattice may serve only for opening and closing an opening part or gateway of a building, and any such opening and closing method can be adopted for it as rotation about a vertical or horizontal axis, back and forth sliding in the facial direction, folding over in the facial direction or rolling in the facial direction.

The lock device may be arranged only for combining the lattice to a closed position, and is provided on a gate post, building or a fixed member secured to the gate post or building such as a window frame, door frame and bracket through the lattice.

Although the lock device may be of a type opened and closed by a key, it is preferably constructed so that it can be easily operated at the time of emergency for releasing the locking function by operating the control means.

Additionally, it is preferable that the control means for unlocking the lock device is constructed so as to unlock the lock device by a simple operation such as pressing, drawing, lifting, lowering or twisting.

Although the control means may be provided in either sides of a gate post, building or a fixed member secured to the gate post or building such as a window frame, door frame and bracket, and the lattice, the front cover of the invention is supported in the side that the control means is provided.

The front cover may be formed in a box-like shape opening in a rear face to avoid connection with the control means from the forward direction, that is so as to cover the control means from five directions, or the forward, rightward, leftward, upper and lower directions, and can be produced by bending a plate material, or by welding a mirror plate in both ends of a grooved mold material formed by press molding or extrusion.

Because the rear cover covers the entire open face of the front cover, and is rotatably supported in a lower part of the front cover, the control means in the front cover is untouchable from a backward direction when the rear cover is placed along the open face of the front cover.

As the rear cover is rotated backwardly, the open face of the front cover is opened, allowing the control means to be operated from a backward direction.

Since the control means is placed in a front part of the front cover within a space surrounding by the rear cover, which is opened backwardly, an intermediate cover and a side cover, the control means is operable from a backward direction by inserting a hand in the space.

However, in order to touch the control means placed in the front part within the space surrounded by the rear cover, which is opened backwardly, the intermediate cover an the side cover, it is required to insert a hand in the spacing surrounded by the rear, intermediate and side covers with an individual's wrist and elbow being bent.

Then, if the intermediate and side covers have a length exceeding the length from an individual's wrist to an individual's finger tip, the control means is untouchable by a hand that is inserted in the space surrounded by the rear, intermediate and side covers with a wrist being bent to be disposed adjacent to the back of the intermediate or side cover.

DETAILED DESCRIPTION OF THE PREFERRED EMBODIMENTS

Figure 1:
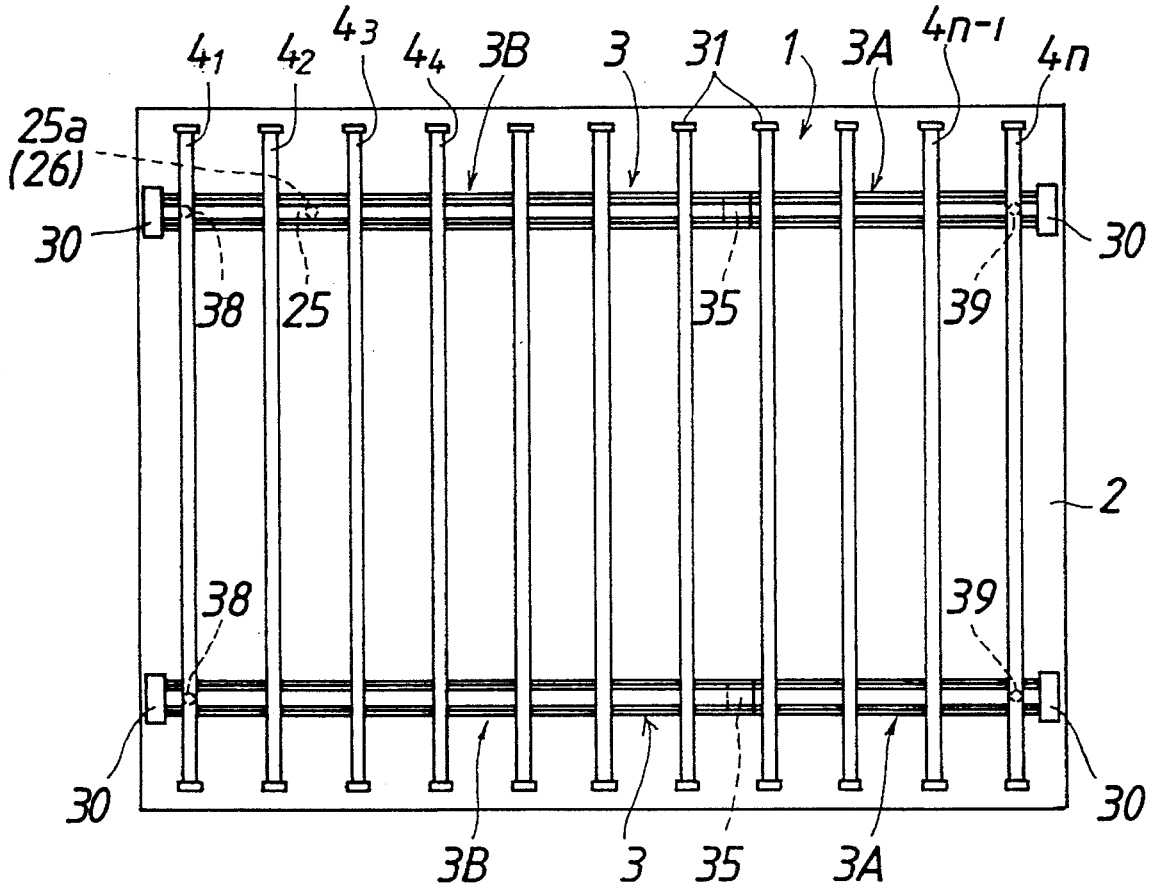
FIG. 1 is a front view showing a lattice of an embodiment of the invention that is attached to a window opening.
Figure 2:
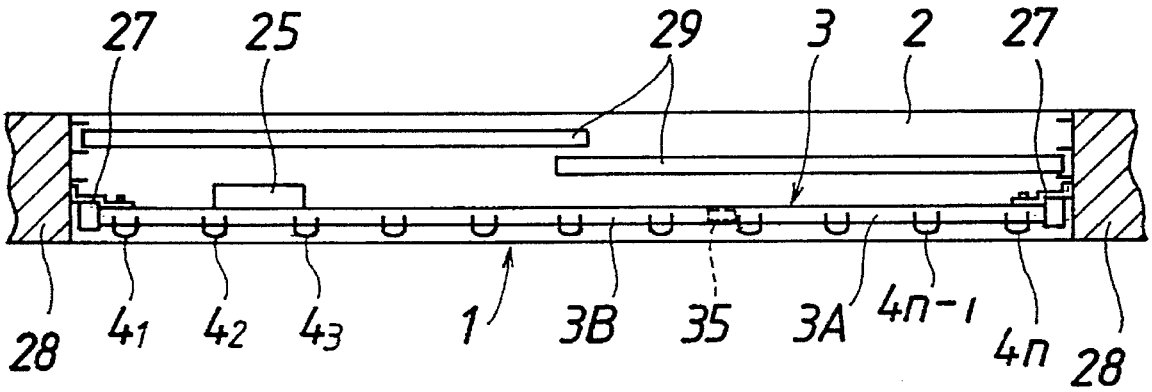
FIG. 2 is a horizontal sectional view of an embodiment of the invention.

In FIGS. 1 and 2, a lattice 1 of an embodiment of the invention that is attached to a window opening 2, and comprises a pair of upper and lower guide rails 3, 3 placed along upper and lower edges of the window opening 2 and a plurality of vertical bars (lattice members) $4_1$ to $4n$ bridged between the guide rails 3, 3 and aligned parallel in the longitudinal direction of guide rails 3, 3.

Figure 3:
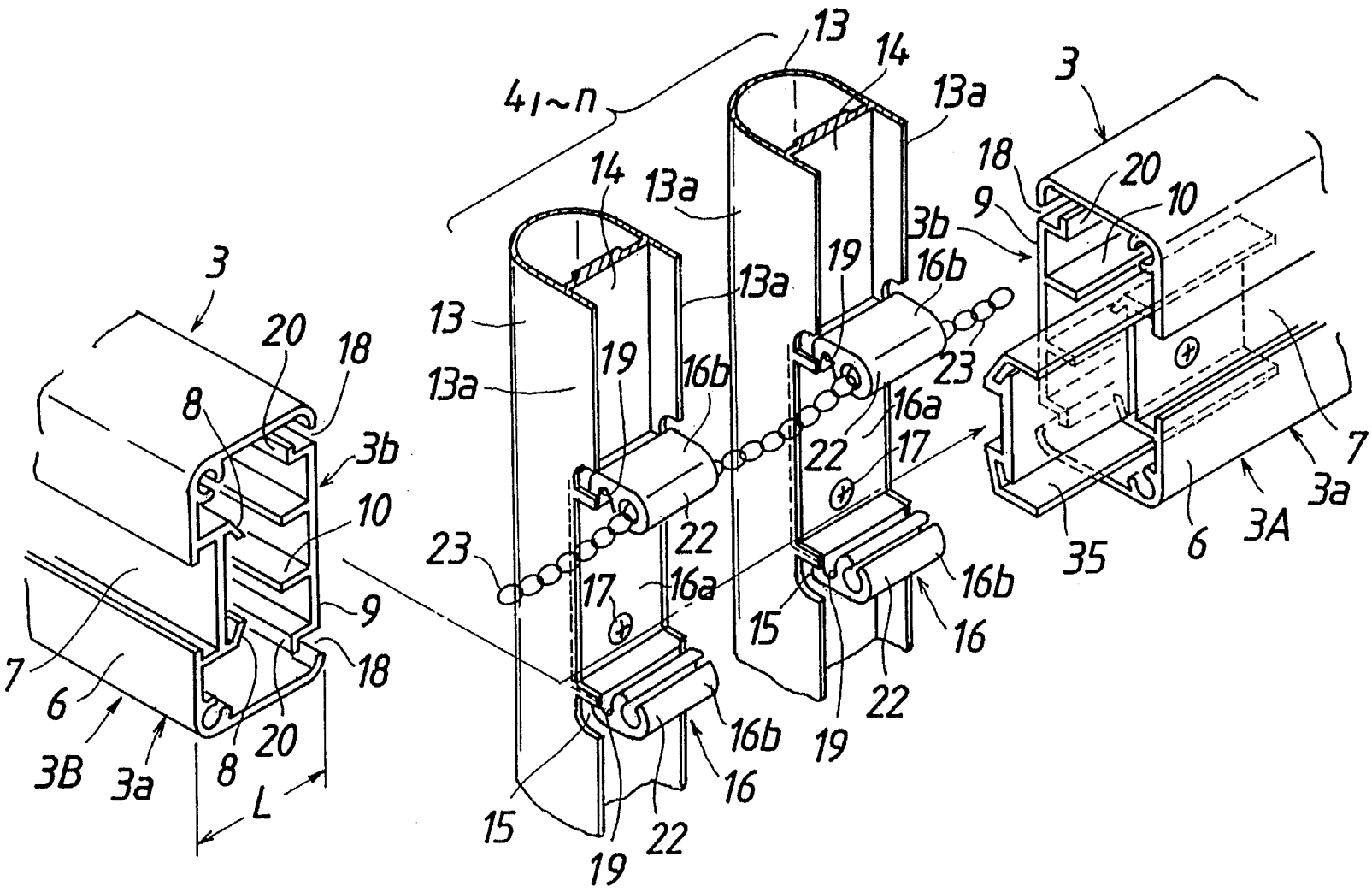
FIG. 3 is an exploded perspective view showing a main part of an embodiment of the invention.
Figure 4:
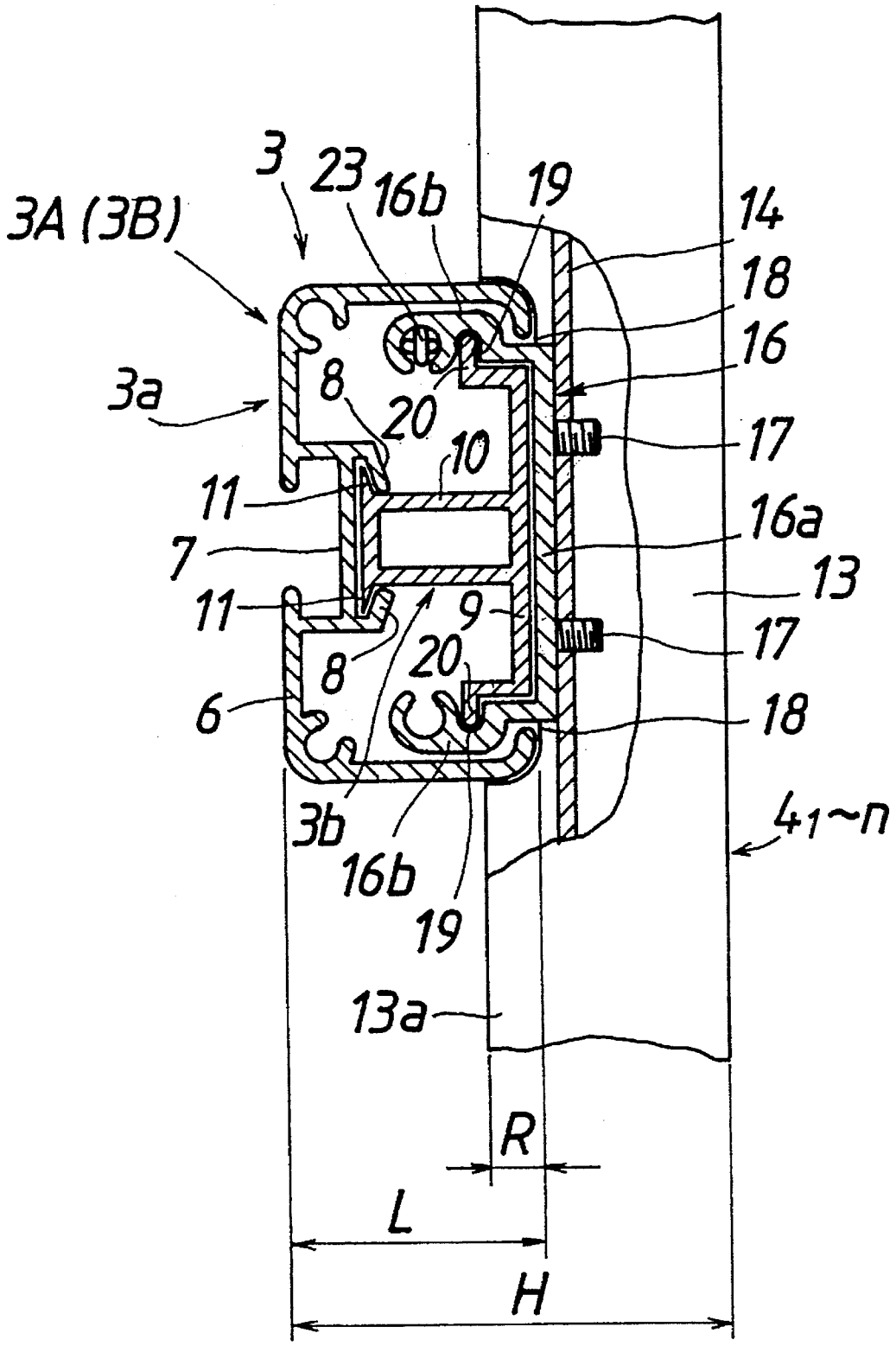
FIG. 4 is a cross sectional view showing a main part of an embodiment of the invention.

The guide rails 3, 3 comprise, as shown in FIGS. 3 and 4, an indoor mold member 3*a* generally having a lateral U shape in a sectional surface thereof and an outdoor mold member 3*b* generally having a T shape in a sectional surface thereof that are formed from aluminum by extrusion molding, a slit recess 7 is formed in a rear wall 6 of the indoor mold member 3*a* along the longitudinal direction of the indoor mold member 3*a*, a pair of strip projections 8, 8 integrally in both corners inside the slit recess 7, a lateral U-shape projection 10 integrally in a front wall 9 of the outdoor mold member 3*b*, and the guide rails 3, 3 are formed in a generally hollow structure by engaging the strip projections 8, 8 with a pair of projections 11, 11 formed integrally in both corners at the leading end of lateral U-shape projection 10, and joining the indoor and outdoor mold members 3*a* and 3*b*.

According to the above structure, the slit recess 7 and lateral U-shape projection 10 integrally engaged with each other are aligned as horizontal bars in the guide rails 3, 3, and the guide rails 3, 3 comes to have a very high strength. Thus, a width L in the indoor and outdoor directions of the guide rails 3, 3 can be reduced.

In addition, both guide rails 3, 3 are divided into a plurality of rail members 3A, 3B, and the rail members 3A, 3B are integrally combined, as shown in FIG. 3, by securing a joint member 35 to one rail member 3A at an end thereof so as to project therefrom, and fitting an end of the other rail member 3B in a projecting part of the joint member 35.

Figure 7:
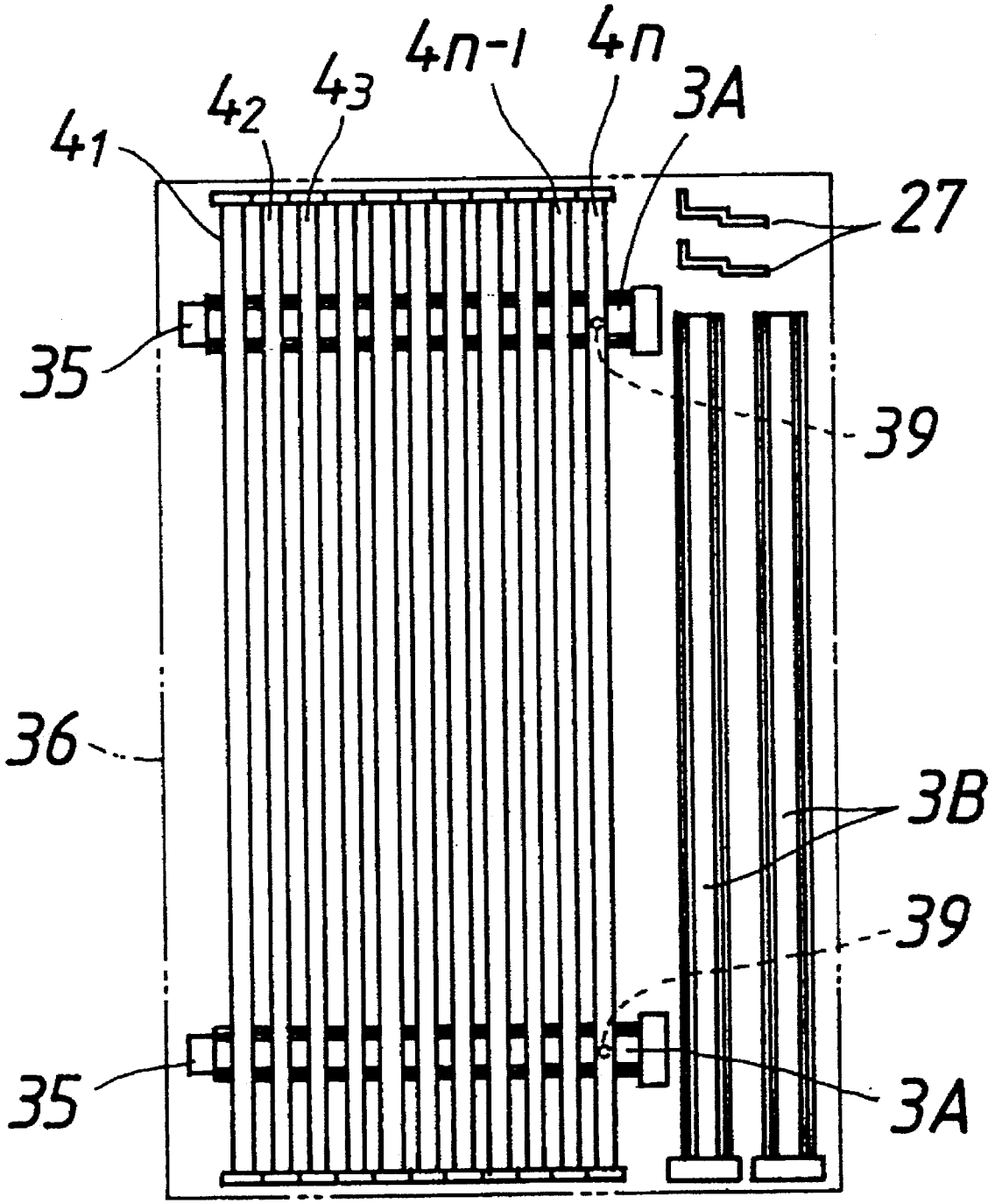
FIG. 7 is a schematic front view showing a lattice of an embodiment of the invention that is in transportation.

According to the structure, because the guide rails 3, 3 can be disassemble to a shorter length for transportation, the bulkiness is eliminated, and transportation cost reduced (see FIG. 7).

The vertical bars $4_1$ to $4n$ comprise extruded aluminum materials, have a main bar body 13 of generally U shape in a sectional surface thereof and a rear wall 14 integrally formed between both side walls 13*a*, 13*a* of the main bar body 13, are provided with concave recesses 15, 15 in the side walls 13*a*, 13*a* at points opposite to the guide rails for overlapping with the guide rails 3, 3, and a slider 16 is provided in the recesses 15, 15.

The slider 16 is formed by cutting a predetermined length from an extruded aluminum material generally having a lateral U shape in a sectional surface thereof, comprises a base plate 16*a* secured to the rear wall of vertical bars $4_1$ to $4n$ by means of a screw 17 and a pair of main slider bodies 16*b*, 16*b* integrally placed in both upper and lower ends of the base plate 16*a* so as to project therefrom, the main slider bodies 16*b*, 16*b* are engaged through a guide groove 18 between the indoor and outdoor mold members 3*a* and 3*b* of the guide rails :3, 3, and engagement recesses 19, 19 formed in the opposing face of main slider bodies 16*b*, 16*b* is slidably fitted to strip projections 20, 20 integrally provided in both upper and lower edges of the front wall 9 of outdoor mold member 3*b*, thus, the vertical bars $4_1$ to $4n$ are slidably engaged in the guide rails 3, 3 by means of the slider 16.

In accordance with the structure, by forming the recesses 15, 15 in the vertical bars $4_1$ to $4n$, the vertical bars $4_1$ to $4n$ are mutually overlapped with the guide rails 3, 3, a depth H of the lattice 1 can be reduced by a width R of the overlapped part, and the lattice 1 can be installed in the window opening 2 (See FIG. 2), because the width L of guide rails 3, 3 is reduced as described (see FIG. 4). Thus, such disadvantage wherein the lattice projects outdoors from the window opening 2, and obstructs traffic can be eliminated.

Moreover, the vertical bars $4_1$ to $4n$ are rigidly combined with the guide rails 3, 3 by means of the slide 16, and a crime preventing function can be securely maintained.

In the above structure, although the slider 16 is secured to the vertical bars $4_1$ to $4n$ by the screw 17, instead, the slider 16 may be integrally formed in both side walls 13*a*, 13*a* of the main bar body 13.

Figure 5:
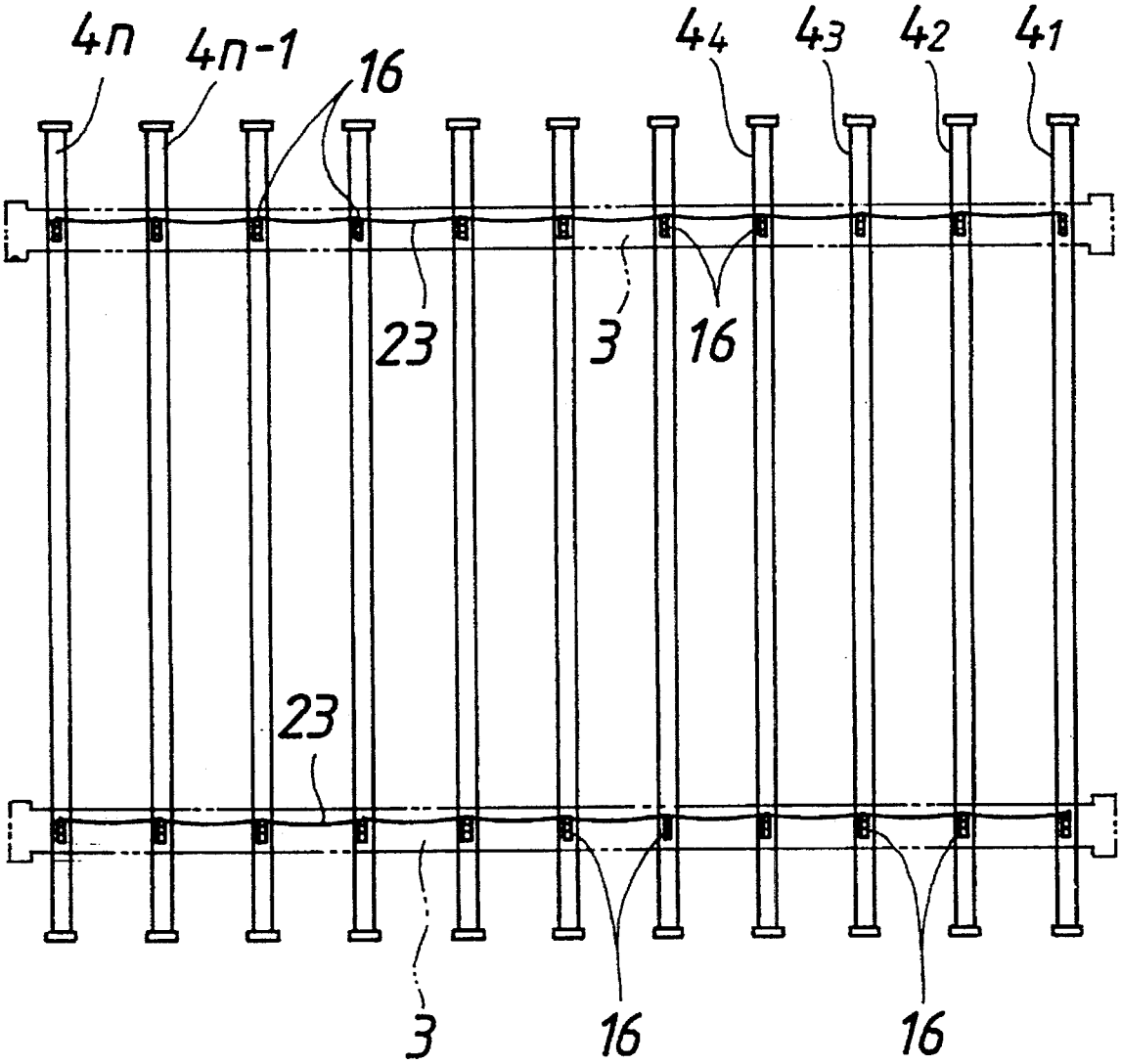
FIG. 5 is a rear side elevation view showing a lattice of an embodiment of the invention.

Arcuate portions 22, 22 are integrally formed in a leading end of main slider bodies 16*b*, 16*b* of the sliders 16, and the vertical bars $4_1$ to $4n$ are integrally combined through a chain 23 by fitting the chain (cord member) 23 in the upper arcuate portion 22, caulking the arcuate portion 22, and integrally fixing the arcuate portion 22 and the chain 23 (see FIG. 5). Therefore, the vertical bars $4_1$ to $4n_{-1}$ can be positioned to predetermined locations on the guide rails 3, 3 simply by fixing the vertical bar 4*n* in one end to the guide rails 3, 3 at an end thereof with a screw 39, and sliding the remaining vertical bars $4_1$ to $4n_{-1}$ along the guide rails 3, 3, and the remaining vertical bars $4_2$ to $4n_{-1}$ are fixed to the guide rails 3, 3 in position only by securing the vertical bar $4_1$ in the other end to the guide rails 3, 3 with a screw 38 (see FIG. 1).

According to the structure, because the chain 23 is housed in the guide rails 3, 3, the chain cannot but cut, a crime preventing function is securely maintained, and a superior appearance can be obtained. As for a material of the chain 23, stainless steel is preferably employed for its anticorrosive property. Also, a wire rope or the like may be used instead of the chain 23.

As shown in FIGS. 1 and 2, a lock device 25 is attached to the upper guide rail 3, and the vertical bars $4_2$ to $4n_{-1}$ can be fixed at predetermined positions on the guide rails 3, 3 by engaging a lock pin 25*a* of the lock device 25 in a lock hole 26 of the slider 16.

Although the vertical bars $4_1$, $4n$ in both ends are fixed to the guide rails 3, 3 with the screws 38, 39 in the embodiment, one vertical bar $4_1$ (or $4n$) of the two may be locked to the guide rail 3 by means of the lock device.

Figure 6:
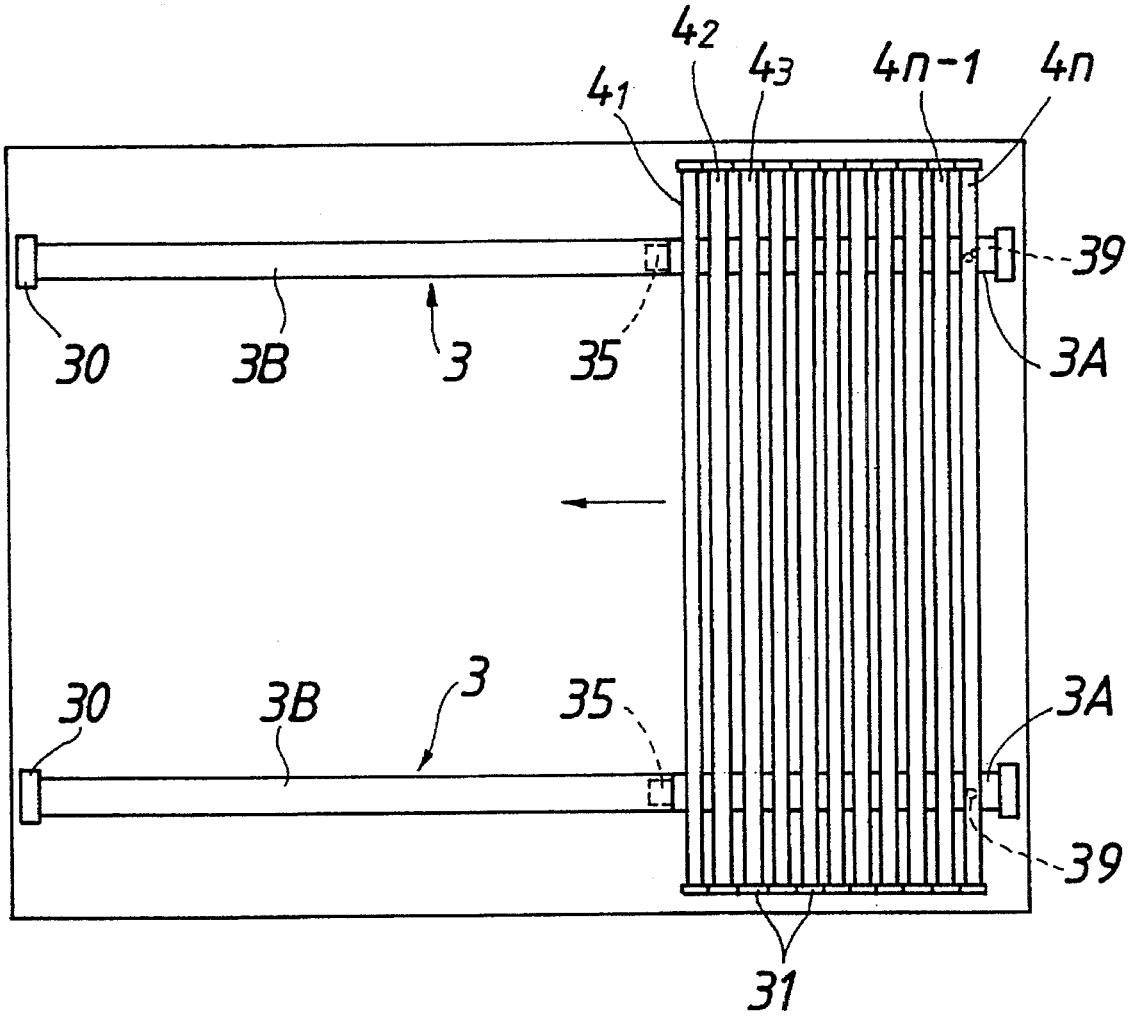
FIG. 6 is a front view showing a lattice of an embodiment of the invention that is opened.

In accordance with the structure, a crime preventing function can be securely maintained in normal circumstances by closing the window opening 2 by the lattice 1, and the window opening 2 can be opened at the time of an emergency such as a fire simply b unlocking the lock device, and sliding the vertical bars $4_1$ to $4n_{-1}$ (see FIG. 6) for an emergency escape to the outdoors through the window opening 2 that is now opened.

In FIG. 1 caps 30, 31 are placed over the ends of guide rails 3, 3 and vertical bars $4_1$ to $4n$. In FIG. 2 a joint fixture 27 is provided for fixing the guide rails 3, 3 to a building body 28, and 29 a window sash.

When the lattice 1 is transported from a plant to an installation site, as shown in FIG. 7, it is packed in a packing case 36 for transportation with the guide rails 3, 3 disassembled to a plurality of rail members 3A, 3B, the vertical bars $4_1$ to $4n$ fitted in one rail member 3A, and the vertical bar $4n$ is fitted in an end fixed to the rail member 3A with the screw 39.

Since the guide rails 3, 3 are disassembled, and the length is reduced approximately to a half thereof, the bulkiness is eliminated, and the transportation cost can be reduced.

At an installation site, the guide rails 3, 3 of an extended length can be formed simply by integrally combining the rail members 3A, 3B by means of the joint member 35, and the lattice 1 can be easily attached to the window opening 2 only by fixing both ends of the guide rails 3, 3 to the building body 28 by means of the joint fixture 27, because the vertical bars $4_1$ to $4n$ are fitted in the rail member 3A as described above (See FIG. 6) The guide rails 3, 3 can be used as a single member without dividing them into a plurality of members.

Then, simply by sliding the vertical bars $4_1$ to $4n_{-1}$ along the guide rails 3, 3, and securing the vertical bar $4_1$ in the other end to the guide rails 3, 3 with the screw 38, the lattice 1 having a crime preventing function can be formed as shown in FIG. 1.

Figure 8:
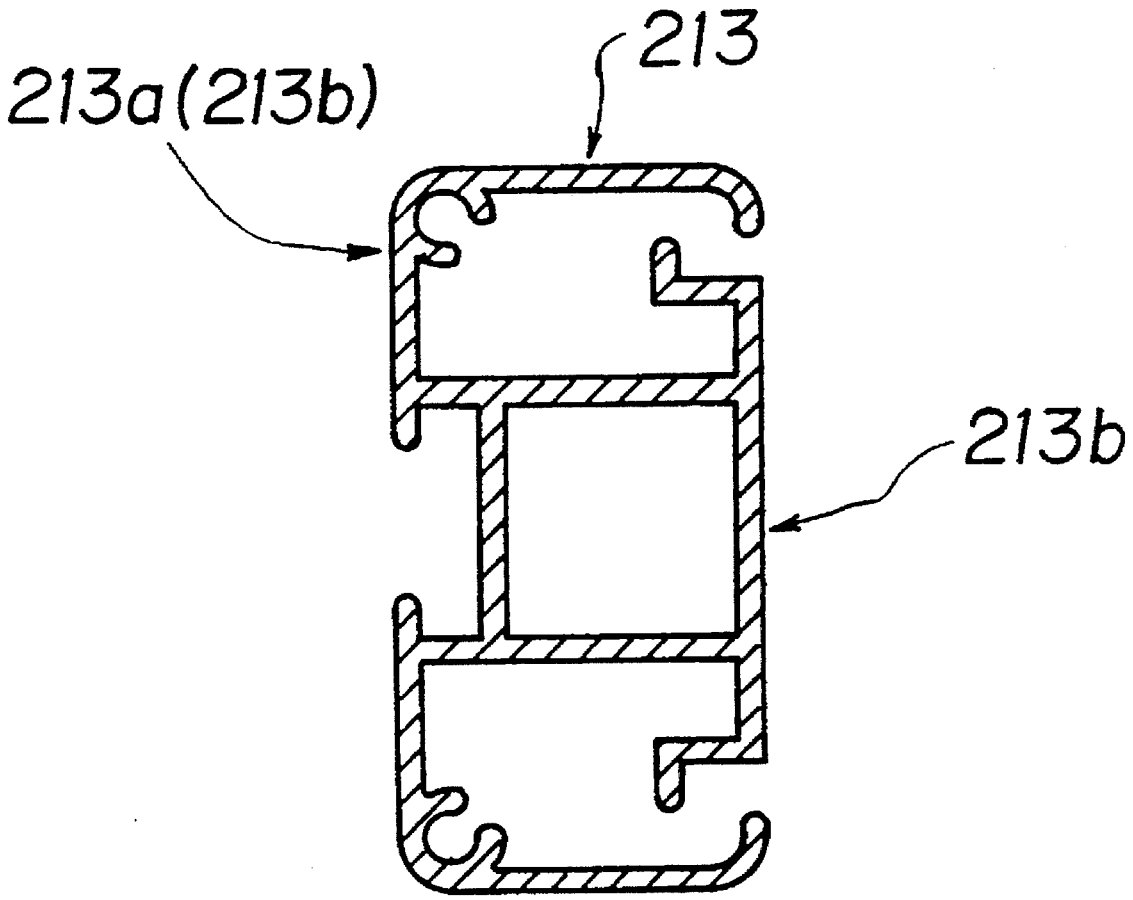
FIG. 8 is a cross sectional view showing an alternative example of a guide rail for use in a lattice of an embodiment of the invention.

Although the guide rails 3, 3 are formed by the indoor mold member 3*a* and outdoor mold member 3*b* that are mutually anastomosed, the mold members 213*a*, 213*b* may be integrally formed as shown in FIG. 8, in such a case, the guide rails 213, 213 can be fabricated at a low cost through a single extrusion molding step with a die.

Figure 9:
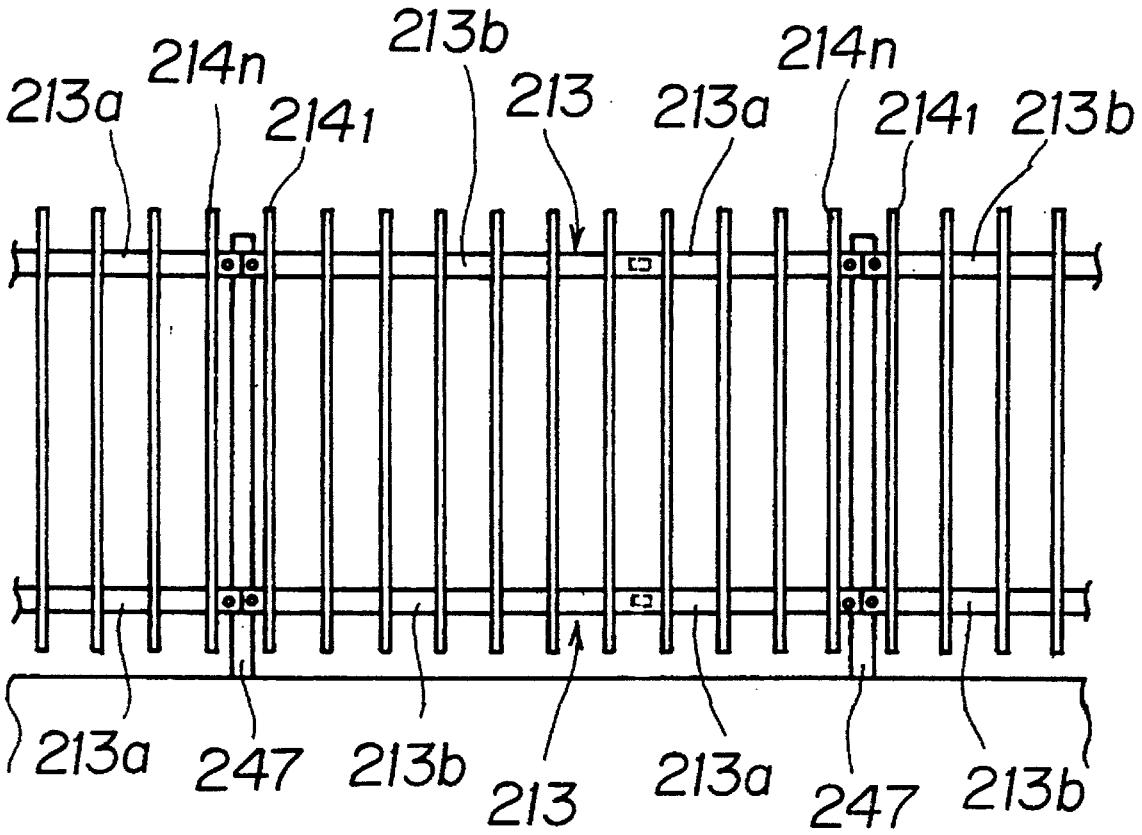
FIG. 9 is a front view showing another embodiment of the invention,.

In addition, although the invention has been described by taking the lattice 1 as an example, it is not limited thereto, a lattice can be formed, as illustrated in FIG. 9, only by securing both ends of the guide rails 213, 213 to a support post 247, sliding the vertical bars $214_1$ to $214n$ that are combined by means of the chain 223 along the guide rails 213, 213 in the direction apart from each other, and fixing the vertical bars $214_1$, $214n$ in the ends to the guide rails 213, 213, and formation of a shutter by attaching the guide rails 213, 213 and vertical bars $214_1$, $214n$ to an entrance as well as a sliding door and the like is also possible.

Figure 10:
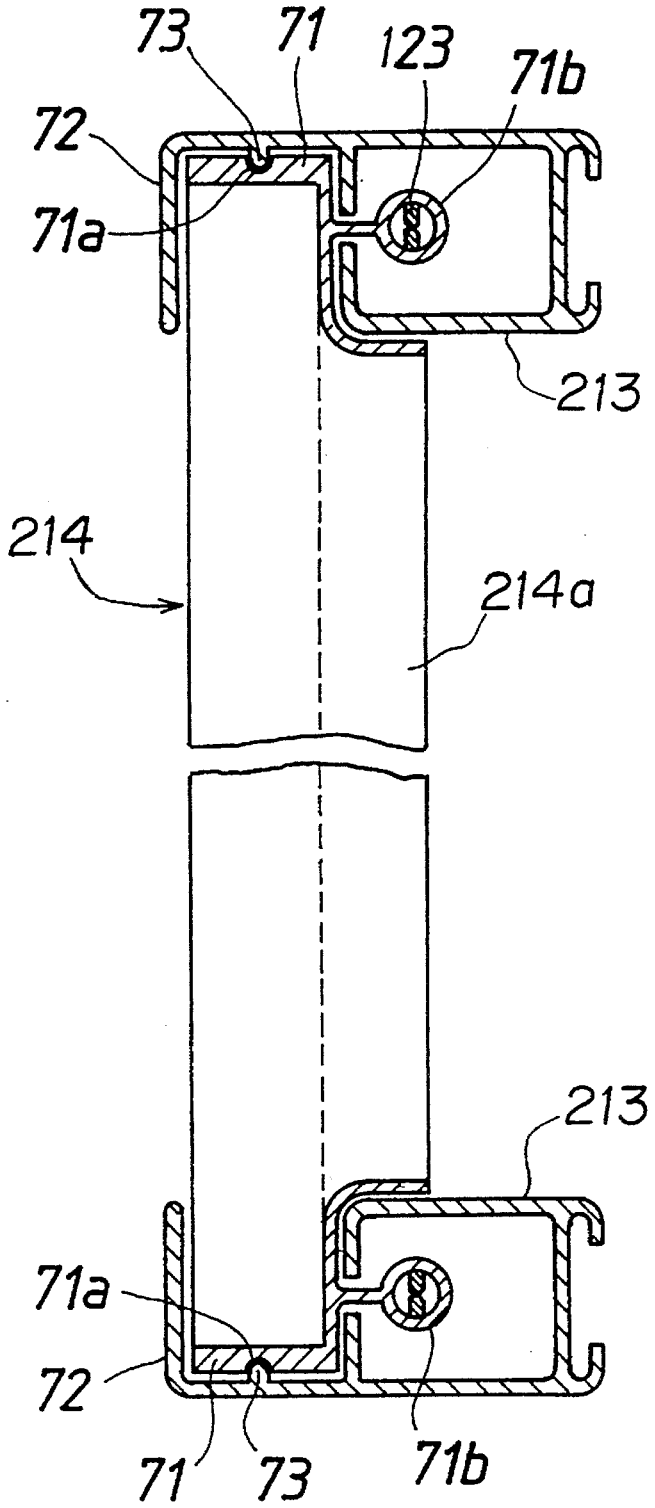
FIG. 10 is a part-cutaway side view showing an alternative structure of a guide rail for vertical bars.

Such structure of slidably engaging the vertical bar 214 to the guide rails 213 by means of a slider can be achieved in various form in addition to the embodiments. For example, sliders 71 with a concave rail track 71*a* or cylindrical part 71*b* for fixing a chain formed therein can be fixed respectively, to upper and lower ends of a main body $214_2$ of the vertical bar 214, as shown in FIG. 10, and the sliders 71, 71 fixed in engagement parts 72, 72 serially provided in the guide rails 213, 213 so that the concave rail track 71*a* in the side of slider 71 is slidable along a sliding projection 73 formed in a inner surface of either engagement parts 72, 72. In such case, as the slider 71 is guided by the engagement 72, and the concave rail track 71*a* by the sliding projection 73, the vertical bar 4 can be slid in a stable manner.

Although the chain 23 223 is employed for combining the vertical bars 4, 214 in above embodiments, it would be clearly appreciated that a cord-like material such as a rope may be used.

Although the lattice 1 of above description utilizes a plurality of vertical bars 4 that are horizontally slid, the vertical bars 4 may be arranged for vertical sliding.

According to the invention, because the lattice members engaged with the guide rails are mutually combined by means of the cord member, the lattice members can be automatically positioned to predetermined locations simply by sliding them in the direction apart from each other, and securing only the lattice members at both ends out of those positioned suffices for fixing the remaining lattice members in position on the guide rails.

In addition, only by fixing to the guide rails one of the lattice members at both ends of the lattice of the invention, and locking the other to the guide rails by means of the lock device, the window opening is closed in normal circumstances, and a crime preventing function can be maintained, and the lock is unlocked and the window opening can be opened in case of an emergency such as a fire for emergency escape to the outdoor through the window opening that is now open.

In the attachment to a window opening, the lattice requires no space for sliding the lattice members in front or the side of the window opening, and is easily installed even in a narrow space.

Furthermore, according to the invention, because the guide rails can be disassembled into a plurality of rail members, and reduced in during length transportation, the lattice is not bulky, and the transportation cost can be reduced.

Moreover, since the lattice members engaged with the guide rails are mutually combined by means of the cord member, only by sliding the lattice members in the direction apart from each other, they can be automatically positioned to predetermined locations on the guide rails, and securing only the lattice members at both ends out of those positioned suffices for fixing the remaining lattice members in position on the guide rails.

Additionally, according to the invention, by mutually overlapping the slider placed in the recess of the lattice member and the guide rails, as the dimension is reduced by a width of the overlapped part, the lattice of the invention can be installed in a window opening in a superior appearance.

Further, because the lattice members and guide rails are rigidly integrated by means of the sliders, a lattice and the like can be formed with superior crime preventing and security functions.

Even more, according to the invention, as the guide rails comprise two mold members in the side of a slider and the opposite side thereof, and both members are mutually joined, a guide rail having a generally hollow structure and high strength can be formed.

According to the invention, because the two mold members constituting the guide rail are integrally formed, respectively, the guide rail can be fabricated at a low cost through a single extrusion molding with a die.

A lock security device of a lattice of the invention is described in detail by referring to the drawings.

Figure 11:
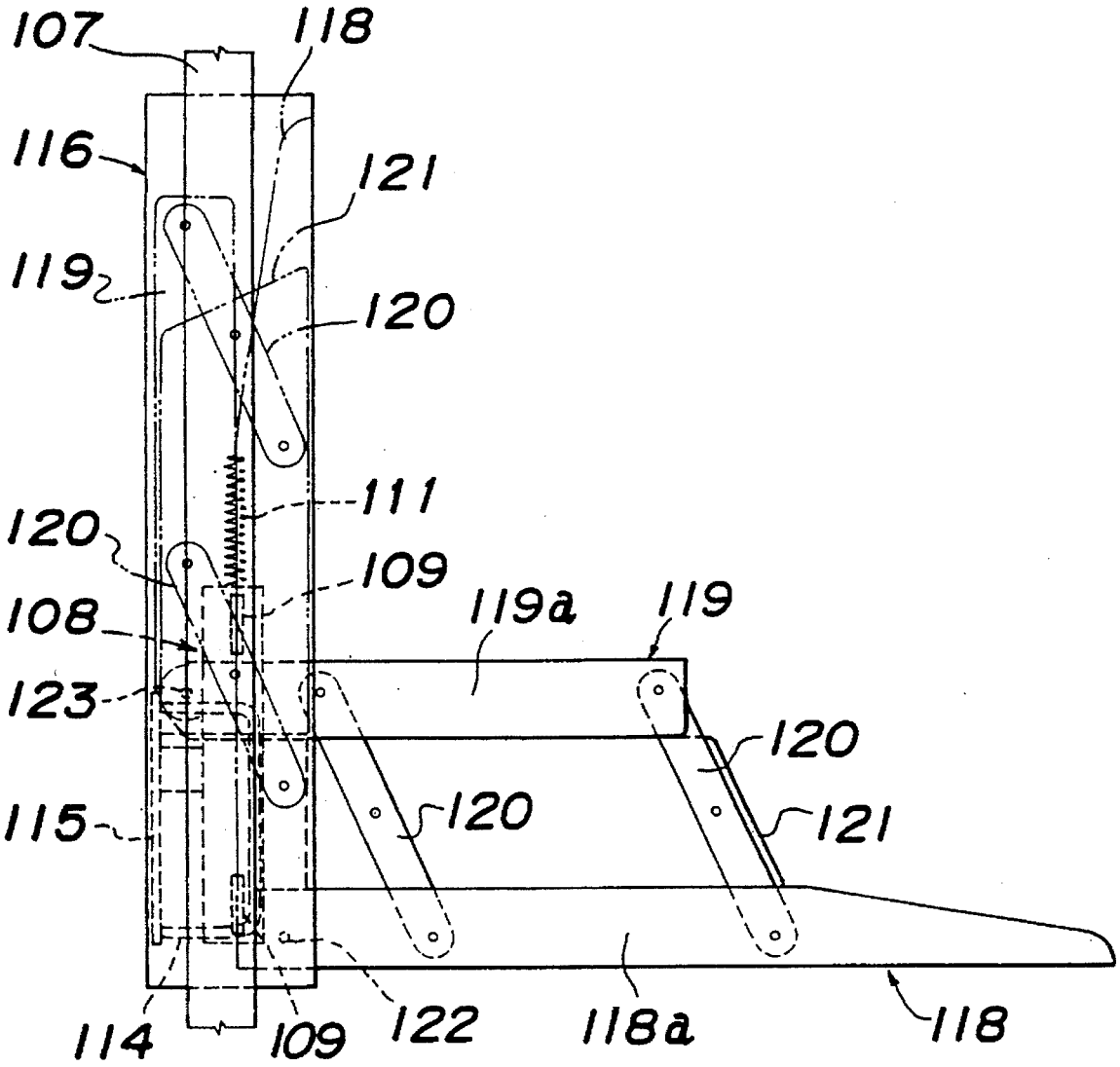
FIG. 11 is a side view of an embodiment of the invention.
Figure 12:
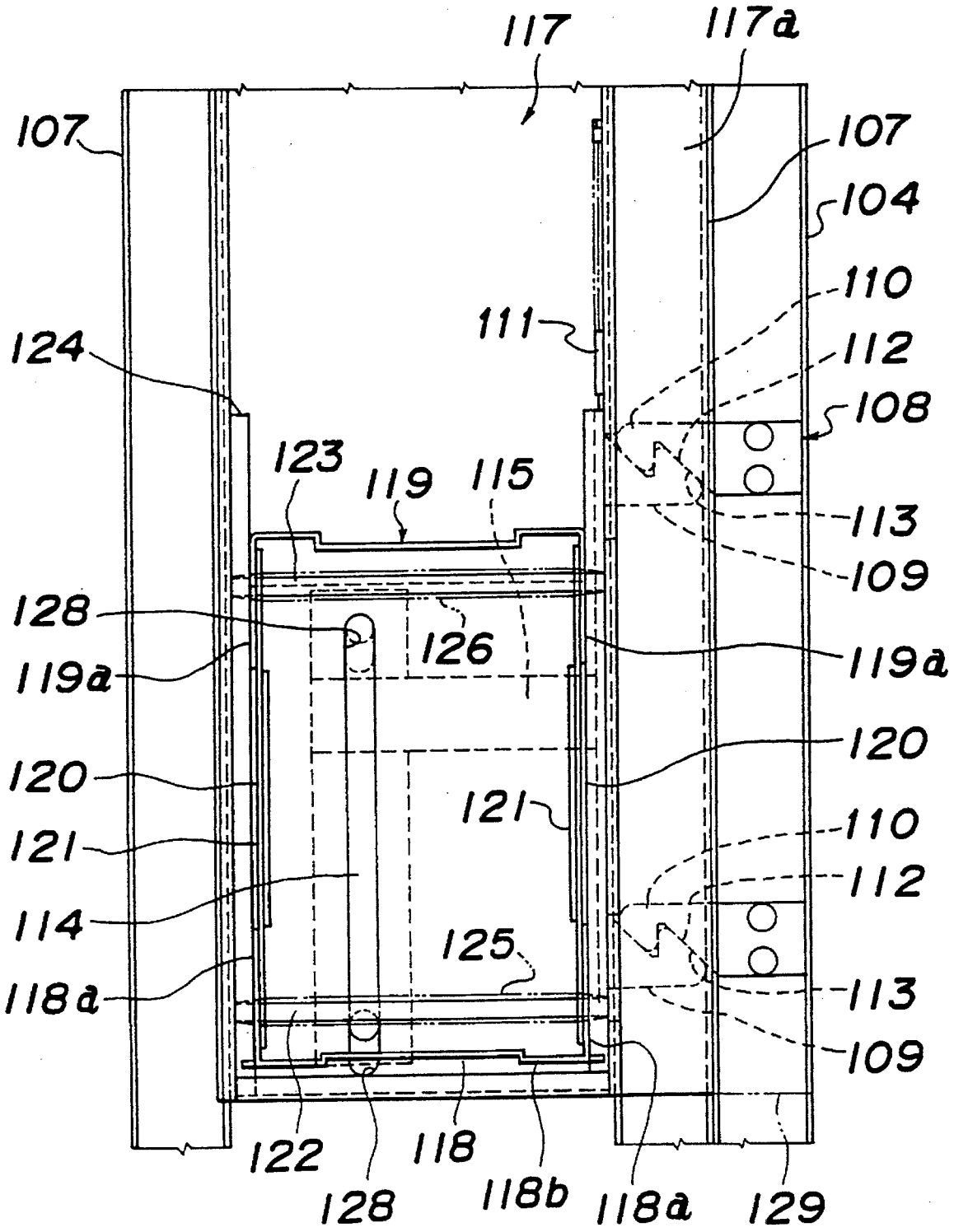
FIG. 12 is a rear side elevation view of an embodiment of the invention.
Figure 13:
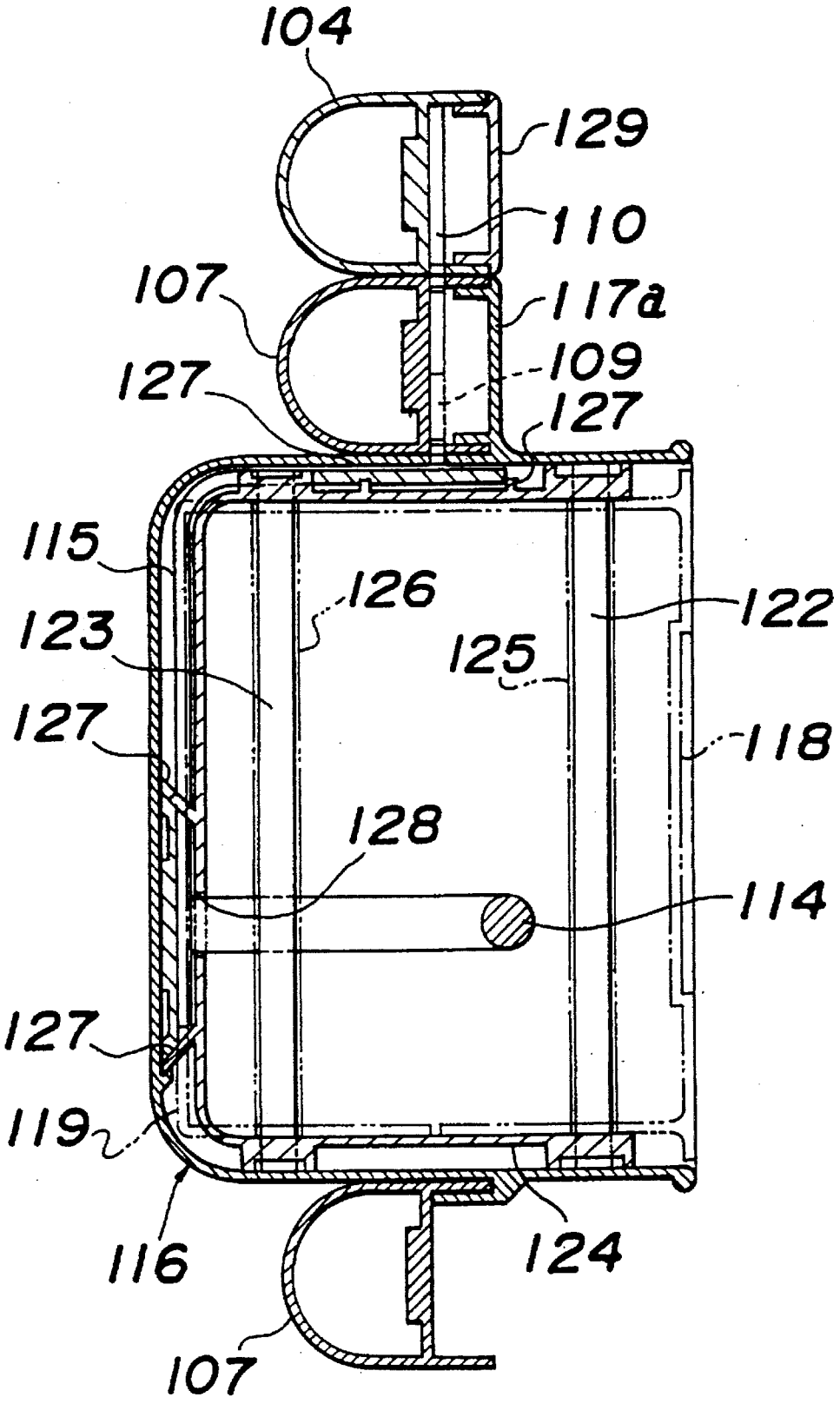
FIG. 13 is a cross sectional plan view of an embodiment of the invention.

FIG. 11 is a side view of a lock security device of a lattice for placement in a building window according to an embodiment of the invention, FIG. 12 a rear side elevation view thereof, and FIG. 13 a cross sectional view. The lattice 101 comprises a flat lattice placed in the front face of a building window, and has vertical bars 103, 104 in both ends that are secured in the vicinity of the building window by means of a fixture 102, as shown in a rear side elevation view of FIG. 14 or 15, a guide rail 105 combining the vertical bars 103, 104 together at an upper end thereof, a guide rail 106 combining the vertical bars 103, 104 together at a lower end thereof, and a plurality of lattice members 107 supported by the guide rails 105, 106 for lateral movement.

Figure 14:
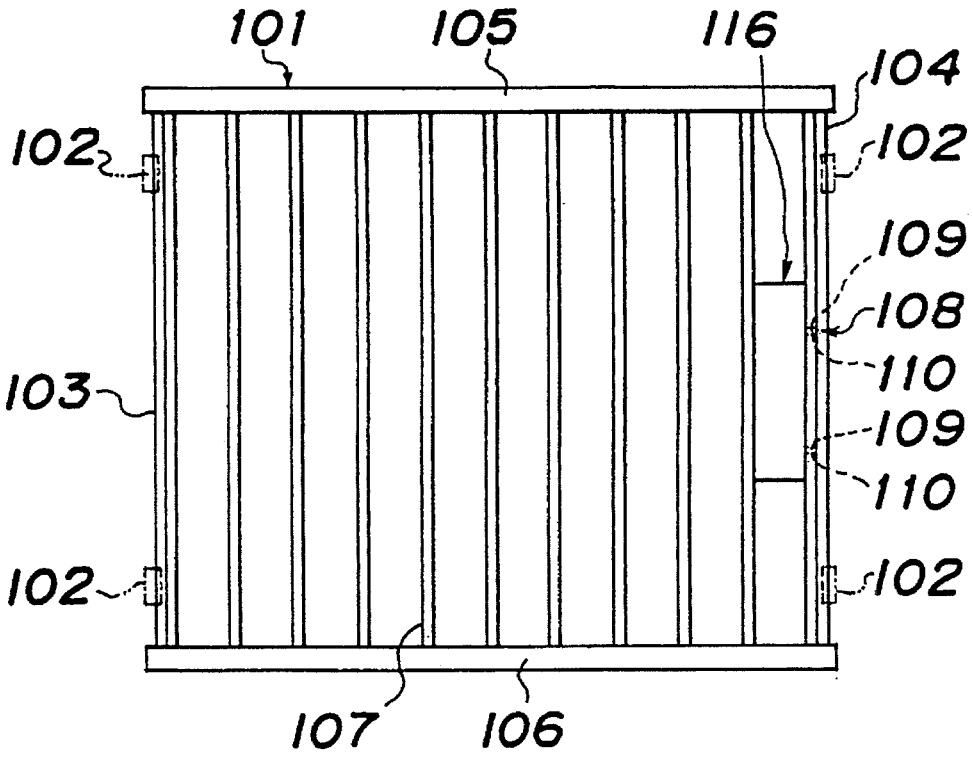
FIG. 14 is a rear elevation view of a lattice in normal circumstances to which an embodiment of the invention is applied.
Figure 15:
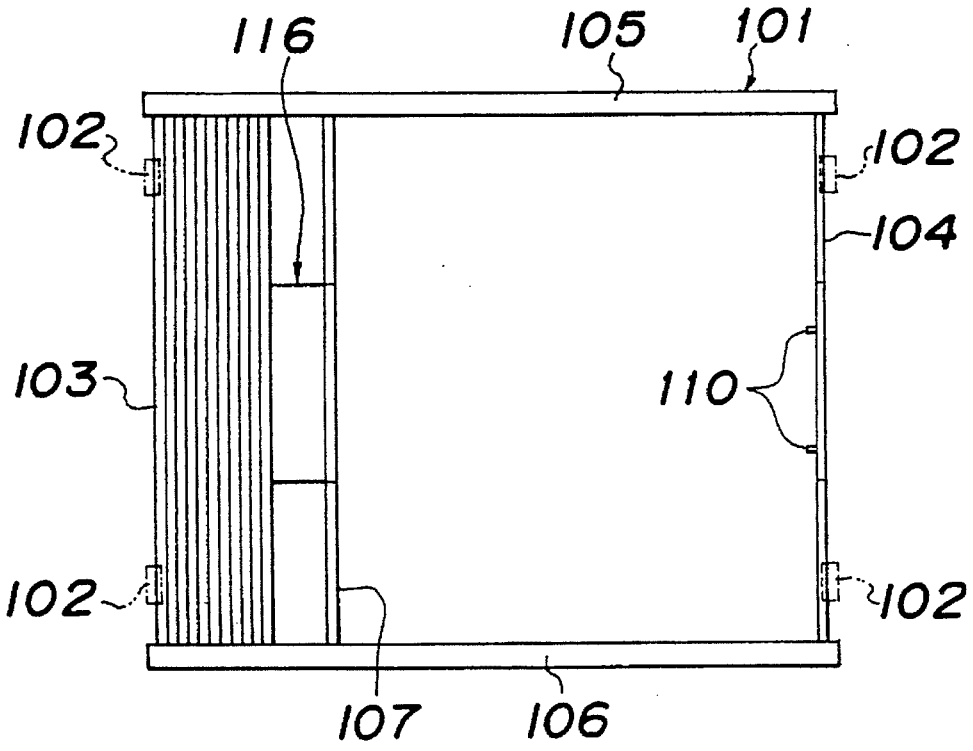
FIG. 15 is a rear side elevation view of a lattice opened at a time of emergency to which an embodiment of the invention is applied.

The lattice members 107 are combined to a left most vertical bar 103 by an interval regulating means not shown such as a chain or wire of a predetermined length and a tensioning coil spring not shown, and the lattice member in the right end is combined to a closed position by the lock device 108 that is provided over the lattice member 107 in the right end through a rightmost vertical bar 104, as shown in FIG. 14, when the lattice member 107 in the right end is moved rightward against the coil spring so as to be abutted against the rightmost vertical bar 104, while the lattice member 107 is drawn leftward by a tensile force of the tensioning coil spring, when the locking function of lock device 108 is released, as shown in FIG. 15 thus, a right half of the lattice is opened.

The lock device 108 may be constructed only for combining the lattice member 107 in the right end to a closed position, and comprises, for simplifying the structure in the embodiment, as shown in FIG. 12, a pair of upper and lower latches 109 having a shape of an upturning hook and supporting the lattice member 107 in the right end for vertical movement, a pair of upper and lower receptacles 110 having a shape of a downturning hook and fixed to the rightmost vertical bar 104 and a lock spring 111 for forcing the latch 109 in the lifting direction.

A working face 112 angularly facing upward is formed in a leading end of the latch 109, and a working face 113 angularly facing downward in a leading end of the receptacle 110. Then, when the lattice member 107 in the right end is drawn toward the rightmost vertical bar 104, the working faces 112 and 113 are abutted against each other, thereby moving the latch 109 downward against the lock spring 111, and the latch 109 is forced upwardly by the lock spring, then, the latch 109 is engaged in the receptacle 110, when the working faces 112, 113 are passed by each other.

Although the leading end of latch 109 is hidden in the lattice member 107, and the leading end of receptacle 110 is arranged so as to project on the left side of the rightmost vertical bar 104 in this embodiment, as shown in FIG. 15, when the lattice member 107 is opened, in the case that the leading end of latch 109 is arranged so as to project on the right side of the lattice member 107, the leading end of receptacle 110 can be hidden in the rightmost vertical bar 104.

In addition, the latch 109 and receptacle 110 are not specifically limited to such hook-like shape, one of them, for example, the latch 110 may project into an open part when opened and may be formed by a bar material bent over in a lateral U shape so that an individual attempting to escape the building is prevented from being caught on the latch by the individual's body or cloth.

Control means 114 for releasing the locking function of lock device 108 is combined with the latch 109 by means of a slide plate 115, the latch 109 is released from the receptacle 110 by manually gripping and moving it downward against the lock spring 11, the lattice member 107 is drawn in the leftward direction by a tensile force of the tensioning coil spring, and the lattice 101 is opened leftward.

In order to prevent the control means 114 from being operated from outside by an individual attempting to break into the building, a lock security device 116 is provided in the lattice 101.

The lock security device 116 comprises a front cover 117, rear cover 118 and intermediate cover 119, and the front cover 117 is formed in a box-like shape surrounding a base end of the latch 109 of lock device 108, the lock spring 11 slide plate 115 and control means 114, and opened in the rear face thereof. The rear cover 118 covers the entire open face of front cover 117, and is rotatably supported in a lower part of the front cover 117, and the intermediate cover 119 is swingably supported in a front part within the front cover 117 at a position higher than the rotational center of the rear cover 118, and is combined with the rear cover 118 by two pairs of parallel links 120.

Both right and left edges **118*a* of the rear cover 118 extend to the side of an intermediate cover 119, both right and left edges 119*a* of the intermediate cover 119 extend to the side of rear cover 118, and both side faces of a space between the rear and intermediate covers 118 and 119 are covered by the right and left edges 118*a*, 119*a* and right and left covers 121 rotatably supported by the parallel links 120**.

In the case wherein both or either of the right and left edges **118*a* of rear cover 118 and the right and left edges 119*a* of intermediate cover 119 extend sufficiently in dimension, as both or either of the rear and intermediate covers 118 and 119 also serve as the side covers 121, it is unnecessary to additionally place the side covers 121**.

Although a shaft 122 pivotally supporting the rear cover 118 and a shaft 123 pivotally supporting the intermediate cover 119 may be supported directly by the front cover 117, in the embodiment, as shown in FIGS. 12 and 13, a groove-shaped holder frame 124 is fixed to the front cover 117 on the inside, and the shafts 122 and 123 are supported by the holder frame 124, so that the rear cover 128 and intermediate cover 119 cannot be disassembled by removing the shafts 122, 123 from the outside.

Torsion coil springs 125, 126 for forcing the rear cover 118 or intermediate cover 119 to the closing direction, that is, the direction of housing them in the front cover 117 is fitted over the shafts 122, 123 as required.

The slide plate 115 is, as shown in FIG. 13, inserted between the front cover 117 and holder frame 124 for vertical movement, and vertically guided by guide ribs 127 formed in the front and right side surfaces of holder frame 124. In addition, as shown in FIG. 12, two slots 128 are formed in the front face of holder frame 124 at positions lower than the shaft 123 supporting the intermediate cover 119 with an appropriate vertical spacing between them.

Then, by inserting both ends of the control means 114 formed in a lateral U shape in the slots 128 for allowing vertical movement, as shown in FIG. 11 or 13, and fixing them to the slide plate 116, the control means 114 is positioned, when viewed from the rear side, deeply in the space surrounded by the intermediate cover 119 that is opened to the back side cover 121 and rear cover 118.

The length of the intermediate and side covers 119 and 121 can be such that a hand bent in the back of an intermediate or side cover, and inserted in the spacing surrounded by the intermediate, side and rear covers 119, 121 and 118 cannot reach the control means 114, and a length in the order of 15 to 20 cm is sufficient.

As shown in FIG. 13, the latch 109 of lock device 108 extends from the front case 117, when necessary, and is covered by a flange **117*a* placed over the rear face of lattice member 107 in the right end, thus, the latch 109 of lock device 108 is prevented from being unlatched from the receptacle 110 by turning a hand in the rear side of lattice 101**.

Also, as shown in FIG. 13, a cover 129 for covering an attachment part of the receptacle 110 of lock device 108 is secured in the rear face of rightmost vertical bar 104, when necessary, in order to prevent the receptacle 110 of a lock device 108 from being removed by turning a hand in the rear side of lattice 101, accordingly.

Moreover, although it is not shown in the figures, a hole for inserting a finger, groove or handle is provided in the leading end of rear cover 118 for allowing easy opening of the rear cover 118.

The rear cover 118, intermediate cover 119, parallel links 120 and side cover 121 of the lock security device 116 of the lattice 101 are folded in the front cover 117 in normal circumstances, as shown in a double-dotted broken line in FIG. 11, and the opening in the rear face of front covers 117 is closed by the rear face **118*b* of the rear cover 118. Therefore, the control means 114 is prevented from being touched from outside by the front and rear covers 117 and 118** in normal circumstances.

In case of an emergency, the rear cover 118 is rotated, and opened to the back. As the rear cover 118 is opened to the back, the intermediate and side covers 119 and 121 combined with the rear cover 118 through the parallel links 120 are also swung in the backward direction, and the control means 114 that is placed deeply in the space surrounded by the rear cover 118, intermediate cover 119 and both side covers 121 is accessible by inserting a hand into the space from the rear side.

However, the control means 114 cannot be reached by a hand from the front side, because it is obstructed by the rear cover 118, intermediate cover 119 and both side covers 121, and the lock device 108 cannot be unlocked.

Since the space is open to the back in the rear side of the lattice 101, the control means 119 is untouchable unless one inserts his or her hand up to the shoulder between the lattice 101 and building or the vertical bars 104 or the lattice member 107 of lattice 101, and reaches the space by bending the individual's elbow, which building impossible, thus, the control means 114 is securely protected against operation from outside by an individual attempting to break into the building.

As described above, in the invention, such simple arrangement that comprises a front cover having a box-like shape with a rear face thereof being open, a rear cover covering the entire open face of front cover, and rotatably supported in a lower part of the front cover, an intermediate cover swingably supported within the front cover in a front part thereof at a position higher than the rotational center of the rear cover, parallel links combining the intermediate and rear covers and side covers covering both side surfaces of a space between the rear and intermediate covers, when the rear and intermediate covers are rotated backwardly, wherein the control means is positioned within the front cover between the intermediate and front covers.

Then, as the lock device and control means for unlocking the lock device are prevented from being touched by inserting a hand in the rear side of the lattice from between the lattice and the building or a spacing in the lattice, breaking into the building by unlocking the lock device from outside can be securely prevented, and a crime preventing function of the lattice is assured.

Additionally, in the cases of an emergency, since the intermediate and side covers are drawn down in the backward direction for allowing operation of the control means only by opening the rear cover, the lattice can be swiftly opened, and never obstructs an emergency escape.

In the invention, the lock security device can be provided in the lattice having an emergency escape function. For the purpose of providing a clear description, the lattice having an emergency escape function and the lattice with the lock security device have been separately described above.

Also, although the invention has been described as a provision of a lattice, it can be applied to a fence device such as a protection fence, shutter or sliding door for crime prevention that is widely employed in various fields.

Moreover, the invention is applicable as well to a lattice in a building for restraining people such as a prison, jail and mental hospital.

What is claimed is:

1. A lattice for use in providing a security closure for an opening comprising:

a plurality of elongated lattice members;

individual sliders being integrated as a member of each of said plurality of elongated lattice members;

a pair of hollow guide rails;

said plurality of elongated lattice members being slidably disposed substantially parallel with respect to each other and being spaced along a length of said pair of hollow guide rails with said individual sliders being engaged within a portion of said hollow guide rails; and a cord member extending within said hollow guide rail and being attachable to each of said individual sliders for securing the positioning of said plurality of elongated lattice members in a first predetermined position.

2. The lattice for use in providing a security closure for an opening according to claim 1, wherein said pair of hollow guide rails are formed in sections and further including a joint member being operatively positioned between sections of said pair of hollow guide rails for securing said sections together.

3. The lattice for use in providing a security closure for an opening according to claim 1, wherein said plurality of elongated lattice members include concave recesses disposed to face said pair of hollow guide rails, said individual sliders being positioned within said concave recesses for forming a mutually overlapping portion between said individual sliders and said hollow guide rails.

4. The lattice for use in providing a security closure for an opening according to claim 1, wherein said pair of hollow guide rails are formed from two molded members mutually joined together for forming a first molded member for receiving said individual sliders and a second molded member for being disposed to oppose said first molded member.

5. The lattice for use in providing a security closure for an opening according to claim 1, wherein said pair of hollow guide rails are formed as a single molded member with a first molded member for receiving said individual sliders and a second molded member for being disposed to oppose said first molded member.

6. A lattice for use in providing a security closure for an opening comprising:

a plurality of elongated lattice members;

individual sliders being integrated as a member of each of said plurality of elongated lattice members;

a pair of hollow guide rails;

said plurality of elongated lattice members being slidably disposed substantially parallel with respect to each other and being spaced along a length of said pair of hollow guide rails with said individual sliders being engaged within a portion of said hollow guide rails;

a cord member extending within said hollow guide rail and being attachable to each of said individual sliders for securing the positioning of said plurality of elongated lattice members in a first predetermined position; and a locking device for selectively retaining said cord for securing the positioning of said plurality of elongated lattice members in said first predetermined position and for selectively enabling said cord to be retracted to displace said plurality of elongated lattice members to a second predetermined position wherein said plurality of elongated lattice members are disposed in a densely arranged side by side positioning with minimum space therebetween, said locking device including a box like member having access only from an interior portion of said opening.

7. The lattice for use in providing a security closure for an opening according to claim 6, wherein said pair of hollow guide rails are formed in sections and further including a joint member being operatively positioned between sections of said pair of hollow guide rails for securing said sections together.

8. The lattice for use in providing a security closure for an opening according to claim 6, wherein said plurality of elongated lattice members include concave recesses disposed to face said pair of hollow guide rails, said individual sliders being positioned within said concave recesses for forming a mutually overlapping portion between said individual sliders and said hollow guide rails.

9. The lattice for use in providing a security closure for an opening according to claim 6, wherein said pair of hollow guide rails are formed from two molded members mutually joined together for forming a first molded member for receiving said individual sliders and a second molded member for being disposed to oppose said first molded member.

10. The lattice for use in providing a security closure for an opening according to claim 6, wherein said pair of hollow guide rails are formed as a single molded member with a first molded member for receiving said individual sliders and a second molded member for being disposed to oppose said first molded member.

11. The lattice for use in providing a security closure for an opening according to claim 6, wherein said box like member includes a cover for providing a closure for said box like member.

* * * * *